US005539503A

United States Patent [19]

Johnson

[11] Patent Number: 5,539,503

[45] Date of Patent: Jul. 23, 1996

[54] MAGNETIC DRIVE FOR A LIQUID TONER CARTRIDGE AND THE LIQUID SUPPLY SYSTEM FOR THE CARTRIDGE

[75] Inventor: Wallace K. Johnson, Boise, Id.

[73] Assignee: Hewlett-Packard Company, Palo Alto, Calif.

[21] Appl. No.: 359,221

[22] Filed: Dec. 19, 1994

[51] Int. Cl.[6] ..... G03G 15/10; F04B 17/00

[52] U.S. Cl. ..... 355/256; 354/324; 417/420

[58] Field of Search ..... 355/256; 354/303, 354/304, 305, 323, 324; 118/659, 660; 417/420

[56] References Cited

U.S. PATENT DOCUMENTS

| | | | |
|---|---|---|---|
| 4,248,514 | 2/1981 | Watkins | 354/324 X |
| 4,378,151 | 3/1983 | Muller et al. | 354/324 X |
| 4,890,131 | 12/1989 | Kuzyk et al. | 354/324 X |
| 5,043,756 | 8/1991 | Takabayashi et al. | 354/324 X |
| 5,153,659 | 10/1992 | Maiefski et al. | 355/356 |
| 5,423,661 | 6/1995 | Gabeler et al. | 417/420 X |
| 5,466,131 | 11/1995 | Altham et al. | 417/420 |

*Primary Examiner*—Fred L. Braun

[57] ABSTRACT

A liquid toner cartridge is provided with internal rotary agitation. The cartridge employs a magnetically-coupled drive, which requires no seals, to provide power to an internal pump and agitation system. The magnetically-coupled drive shaft falls in line with the pump and agitation device. Venting is through a single liquid supply/return line. When the line empties between pumping cycles, the cartridge can vent to the atmosphere. During pumping, a flexible tank, external to the liquid toner cartridge, partially collapses, but returns to original shape when toner has returned at the end of each development cycle. At this point, the supply/return line is again opened to the atmosphere for venting. This action always maintains space for the rotary agitation system.

16 Claims, 6 Drawing Sheets

MAGNETIC DRIVE FOR A LIQUID TONER CARTRIDGE AND THE LIQUID SUPPLY SYSTEM FOR THE CARTRIDGE

TECHNICAL FIELD

The present invention relates generally to electrographic printing, and, more particularly, to liquid toners used in such systems and to a liquid toner cartridge.

BACKGROUND ART

Electrophotographic laser printing employs a toner containing pigment components and thermoplastic components for transferring a latent image formed on selected areas of the surface of an insulating, photoconducting material to an image receiver, such as plain paper, coated paper, transparent substrate (conducting or insulative), or an intermediate transfer medium.

There is a demand in the laser printer industry for multicolored images. Responding to this demand, designers have turned to liquid toners, with pigment components and thermoplastic components dispersed in a liquid carrier medium, usually special hydrocarbon liquids. With liquid toners, it has been discovered that the basic printing color (yellow, magenta, cyan, and black) may be applied sequentially to a photoconductor surface, and from there to a sheet of paper or intermediate medium to produce a multi-colored image.

The liquid toner must be dispersed uniformly in the liquid hydrocarbon carrier medium, since the toner tends to settle out. Such uniform dispersion requires some sort of agitation, which must be provided without permitting leakage of the liquid. Thus, leakage must be minimized to the extent possible, in order to prevent loss of liquid and all the attendant problems associated with spillage of liquid inside an electrographic printer.

Use of a mechanically-coupled external pump to internal rotary agitation requires running seals, which can, over time, degrade and hence become prone to cracks and wear, which enable leakage of the liquid to occur. Conventional gear-coupled drive shafts also have the problem of lining up orthogonal to the pump and agitation device, due to space limitations in the printer.

While it is desired to use vent holes to equalize the pressure inside the cartridge as the toner is used up, such vent holes, of course, also provide an opportunity for leakage of the liquid toner. To circumvent the problem of employing vent holes, collapsible poly-bags have been employed, which collapse as liquid toner is consumed. The collapse of the poly-bag, however, leaves no room for a rotary agitation device inside the cartridge after the bag has partially collapsed.

Thus, there remains a need for a liquid toner cartridge which permits rotary agitation while eliminating most if not all of the foregoing problems.

DISCLOSURE OF INVENTION

In accordance with the invention, a liquid toner cartridge is provided with optional internal rotary agitation. The cartridge, which is intended for use in electrographic image production, e.g., printing, employs a magnetically-coupled drive, which requires no seals, to provide power to an internal pump and the optional agitation system. The magnetically-coupled drive shafts fall in line with the pump and agitation device. Venting is through a single liquid supply/return line. When the line empties between pumping cycles, the cartridge can vent to the atmosphere. During pumping, a flexible tank, integral to the liquid toner cartridge, partially collapses, but returns to original shape when toner has returned at the end of each development cycle. At this point, the supply/return line is again opened to the atmosphere for venting. This action always maintains space for the rotary agitation system.

The liquid toner cartridge of the invention comprises:

(a) a liquid-tight housing for containing liquid toner therein, the liquid toner comprising a dispersion of toner particles in an inert liquid carrier, the housing provided with a hollow boss at one end thereof, the housing further provided with a liquid inlet/outlet port adapted to be connected to an external liquid toner reservoir or developer in printer, the housing having an elongated axis;

(b) a magnetic rotor within the boss, the magnetic rotor adapted to be magnetically coupled to a magnetic motor driver outside of the boss;

(c) a pump for reversibly pumping the liquid toner from the external liquid toner reservoir into the housing and back; and (d) a means for venting the interior of the housing to the atmosphere during a cycle.

Optionally, the liquid toner cartridge further includes a rotatable agitation system within the housing and along the elongated axis. The rotatable agitation system is driven by a gear train mechanically coupled to the magnetic rotor and stirs the toner particles to maintain the dispersion. In this case, the pump is a gear pump which is a part of the agitation gear train.

The cartridge has no running seals or vent holes to the atmosphere that could leak during handling, and has no internal switching valves. Switching direction of pumping is accomplished by reversing motor direction. Extended agitation is accomplished without pumping toner by running motor in direction which pumps toner into cartridge with external toner reservoir empty.

BEST MODES FOR CARRYING OUT THE INVENTION

Liquid toner comprises a dispersion of solid toner particles in a liquid carrier. These particles tend to settle out over a period of time, unless agitation is provided. In accordance with the invention, a liquid toner cartridge is provided, having internal agitation provided without requiring mechanical coupling from an external motor to the internal agitation means. The liquid toner cartridge of the invention allows for some settling of particles and will remix toner when required.

Figure 1:
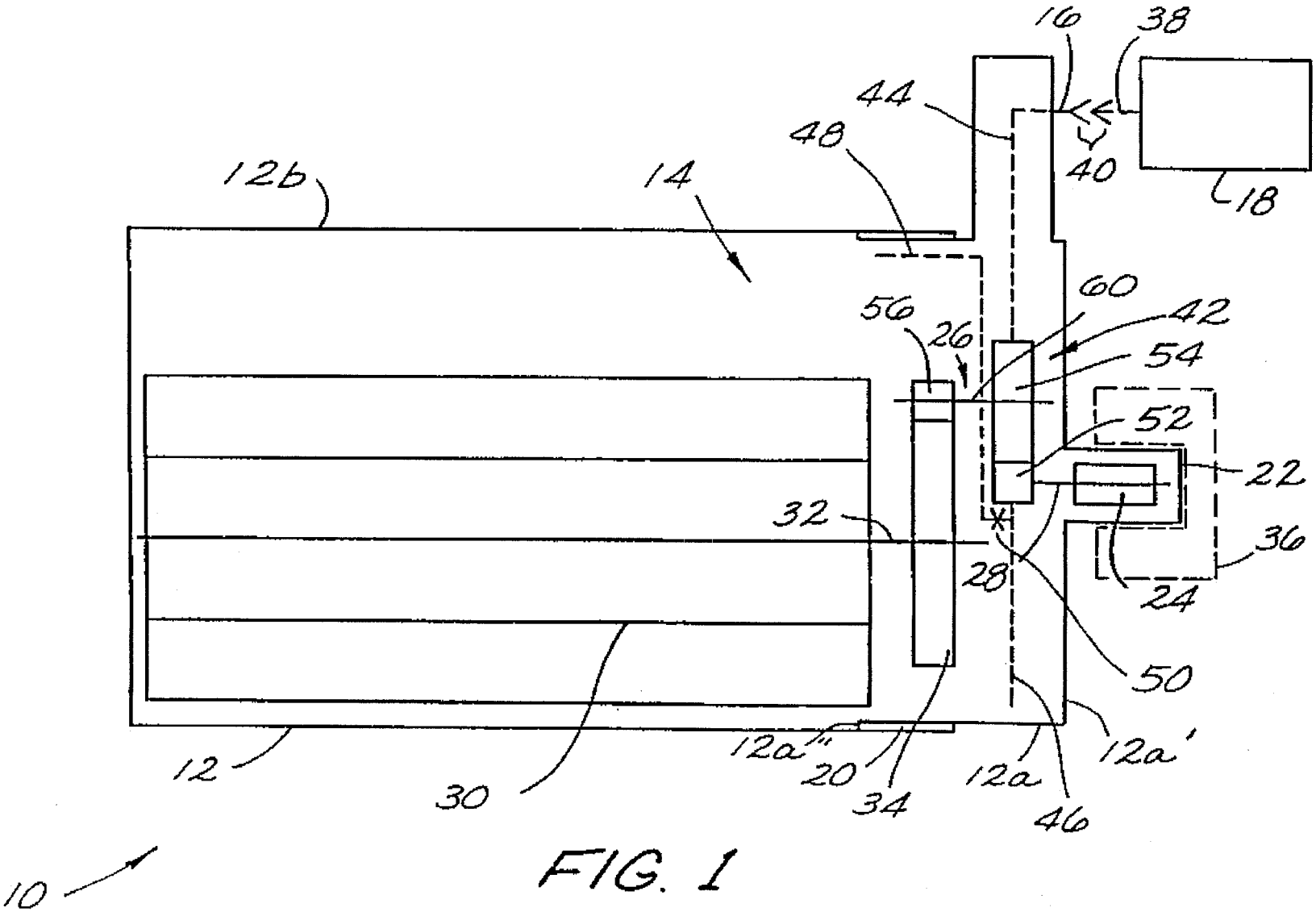
FIG. 1 is a side elevational view, cutaway, showing the liquid toner cartridge of the present invention.

Turning now to the drawings wherein like elements of reference denote like elements throughout, a liquid toner cartridge 10 is depicted. As shown schematically in FIG. 1, the cartridge 10 comprises a leak-proof housing 12 for containing the liquid toner (not shown), rotary agitation means 14, and at least one inlet/outlet port 16 (one is depicted in FIG. 1) for transporting liquid toner from the cartridge to an external development reservoir 18 (not shown to scale) and to return liquid toner to the cartridge. In this connection, it will be appreciated by those skilled in this art that some toner is pumped to reservoir 18 for a development cycle and then excess toner is pumped back into the cartridge 10 for storage until the next cycle. By a cycle is meant the following sequence of activities:

1. Pump liquid toner to development reservoir 18 from cartridge 10;
2. Develop and transfer image from toner to photoconductor drum (not shown);
3. Pump excess toner back to cartridge 10 from development reservoir 18;
4. Reservoir is now empty and open to the atmosphere; venting takes place; and
5. Now ready to begin with next image to be printed.

Figure 2:
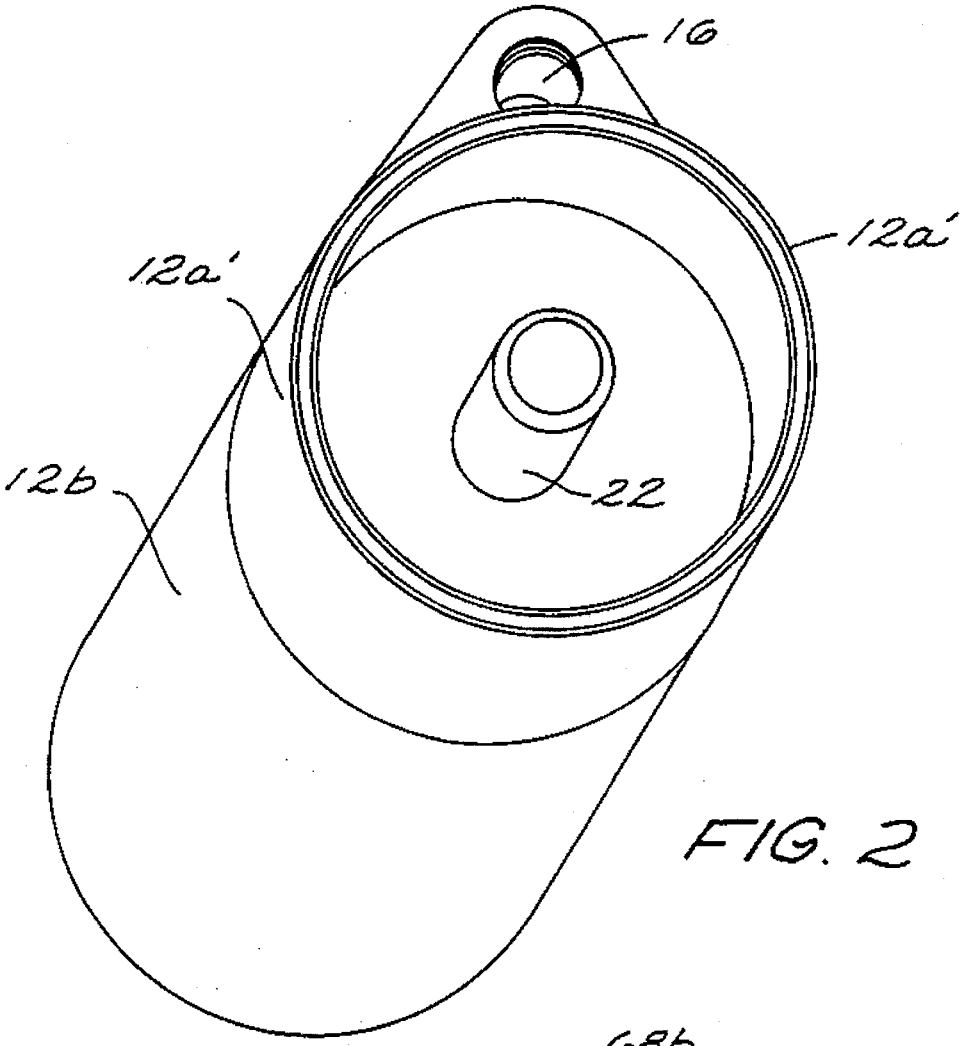
FIG. 2 is a perspective view of one end of the liquid toner cartridge of the invention, which is magnetically coupled to a motor external of the liquid toner cartridge.

The leak-proof housing 12 comprises a rigid support member 12*a* and a tank casing 12*b* securely attached thereto. The rigid support member 12*a*, which comprises a non-magnetic material for reasons described below, has a substantially cylindrical shape, closed at one end 12*a*' thereof. The opposite end 12*a*", which is open, is provided with flange means 20 for securing the tank casing 12*b* to the rigid support member 12*a*. The center of the end portion 12*a*' is provided with an outwardly projecting boss member 22, the interior of which is hollow and adapted to contain a magnetic rotor 24. The rigid support member 12*a* also includes the inlet/outlet port 16. FIG. 2 is a perspective view of the cartridge 10, depicting end portion 12*a*' and showing the boss member 22.

Returning to FIG. 1, the tank casing 12*b* may be flexible or rigid. If flexible, the tank casing 12*b* is nonetheless stiff enough to resist collapse and to enable a vacuum to be drawn during consumption of the liquid toner. The tank casing 12*b* is secured to the flange 20 of the rigid support member 12*a* by any number of means, including clamping the outer perimeter of the tank casing and employing an O-ring (not shown) for sealing, providing both the flange and the inner surface of the tank casing with threads for screwing the tank casing onto the flange (where both the rigid support member and the tank casing comprise a rigid plastic, such as an acetal), welding (again, where both the rigid support member and the tank casing comprise a rigid plastic, such as acetal, and employing ultrasonic plastic welding), and the like.

The magnetic rotor 24 is connected to a gear train 26 by a rotor shaft 28. The gear train 26 serves to reduce the speed of the magnetic rotor 24 for gentle agitation of the liquid toner by an agitation paddle 30, which is mounted on a fixed shaft 32, connected to the last gear 34 in the gear train. However, if agitation of the liquid toner is not contemplated, then the gear train 26 is not essential, and a simple pump, such as a magnetically-driven pump (not shown) is employed.

The magnetic rotor 24 is driven by a magnetic motor driver 36 in the printer; only a portion of the magnetic motor driver is shown in FIG. 1, in phantom. Use of a non-magnetic material for the rigid support member 12*a* permits magnetic coupling of the motor driver 36 to the rotor 24. The magnetic coupling eliminates the need for a running seal between an external motor driver and the interior gear train 26.

The inlet/outlet port 16 is connected to the reservoir 18 by a supply line 38 through a fluid connector 40.

A gear pump 42, which is a part of the gear train 26, reversibly pumps the liquid toner from the external reservoir 18 to the rotatable agitation means 30 and back. As indicated above, if the gear train 26 is omitted, then a simple pump, such as a magnetically-driven pump, may be used to reversibly pump the liquid toner.

The movement of liquid (and air) is accomplished on one side of the gear pump 42 via supply route 44, which is connected to the inlet/outlet port 16. On the other side of the gear pump 42, toner intake/return is provided along supply route 46; air intake to the interior of the cartridge 18 is provided along supply route 48, through an orifice 50 inside the gear train 26. The function of the orifice 50 is described in greater detail below. The various components related to the movement of air permit venting of the interior of the cartridge 10 to the atmosphere during a cycle. The specific details of the features of the gear pump 42 and the venting are described below.

Figure 3:
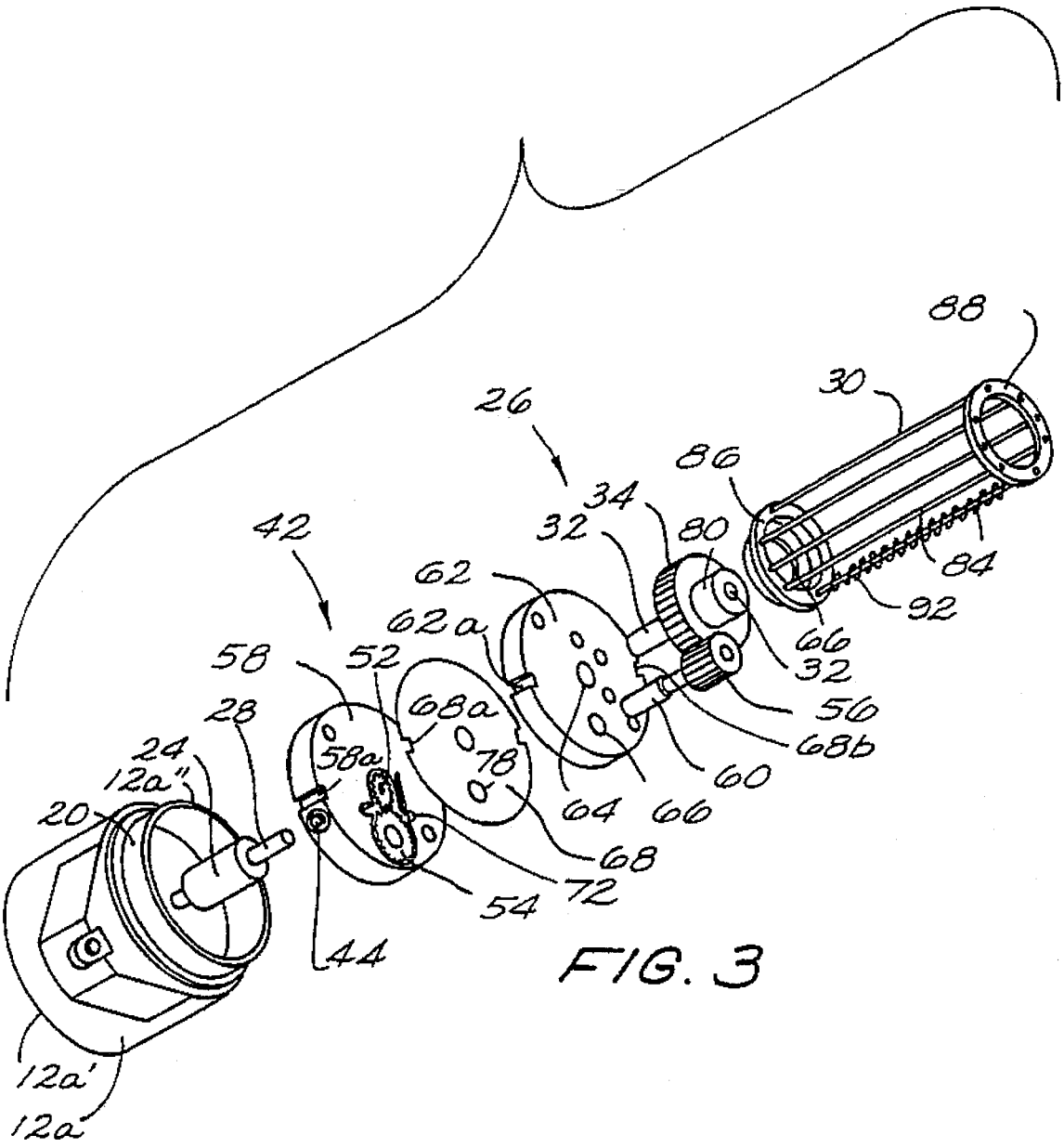
FIG. 3 is a perspective, exploded view of the liquid toner cartridge of the invention.

FIG. 3 is an exploded perspective view, depicting the interior details of the liquid toner cartridge 10. For clarity, the tank casing 12*b* is omitted from the drawing.

Figure 4:
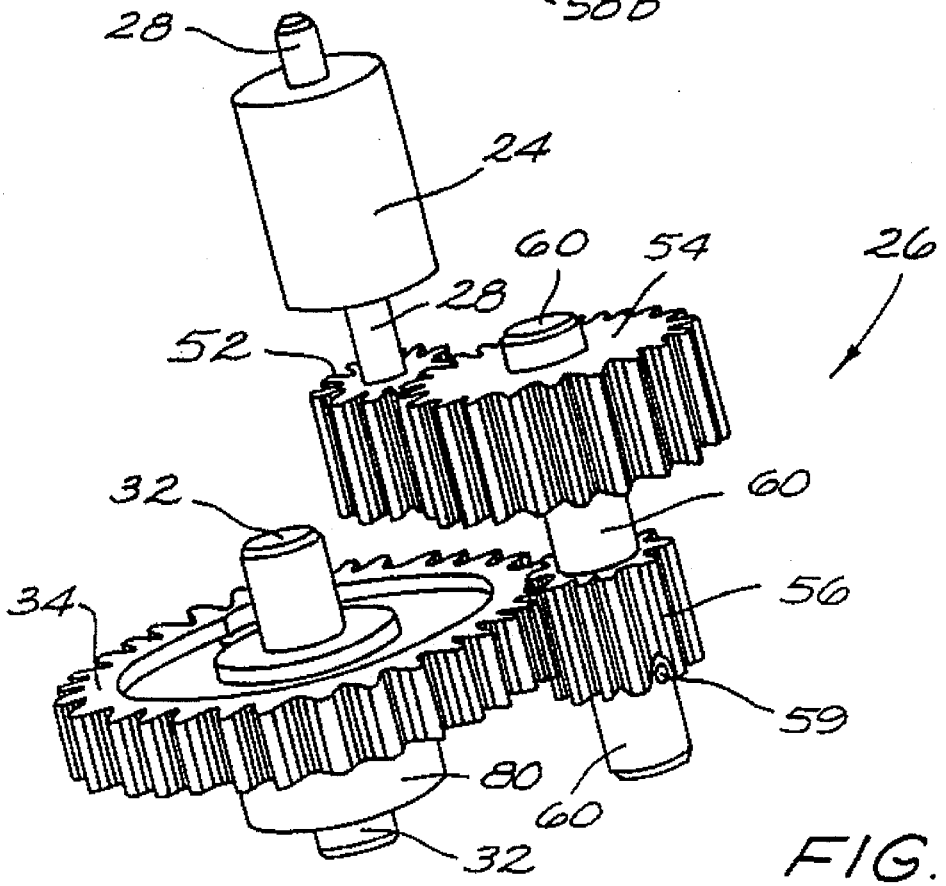
FIG. 4 is a perspective view of a gear train employed in the liquid toner cartridge, also showing those gears used to form a gear pump.

As shown in detail in FIG. 4, the gear train 26 comprises four gears, 52, 54, 56, and 34. Gear 52 is connected to the rotor shaft 28, such as by slip-fit and "D" hole. Gear 52 is directly coupled to gear 54; both gears 52 and 54 are supported in a gear plate 58 (see FIG. 3). Gear 52 is as small as possible, while gear 54 is as large as possible to provide reduced gear ratio. As an example, the gear ratio from gear 52 to gear 54=2.3 and the gear ratio from gear 56 to gear 34=4, making the gear ratio from gear 52 to gear 34=2.33×4=9.32. Gears 52 and 54 together comprise the gear pump 42, which is discussed in greater detail below.

Gear 56 is mounted and pinned with pin 59 on a gear shaft 60, which in turn is connected to gear 54, such as by press-fit. Gear 34 is directly coupled to gear 56. Consequently, rotation of rotor shaft 28 is translated through the gear train 26 to cause rotation of the gear 34.

Figure 5:
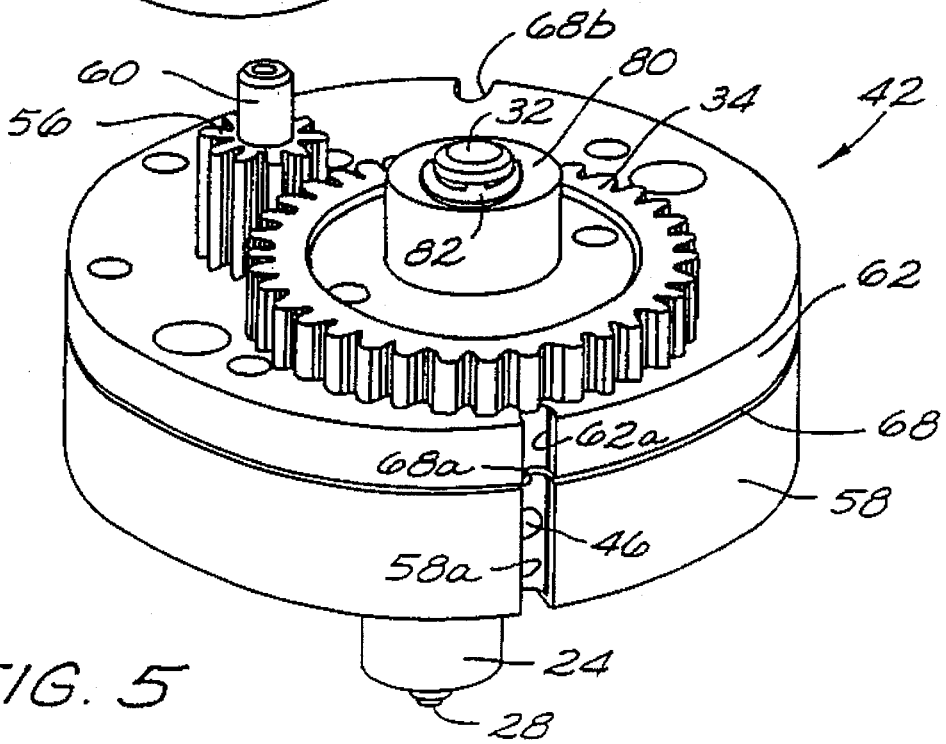
FIG. 5 is a perspective view of the gear pump assembly.

As shown in FIG. 5, a plate cap 62 is provided with a hole 64 in the center thereof (visible in FIG. 3) for supporting shaft 32, on which gear 34 is mounted; the shaft is press-fit in the hole. Alternatively, the plate cap 62 may be fabricated with gear shaft 32 as an integral part thereof. The plate cap 62 does not rotate.

The plate cap 62 serves several functions, including as a seal during pumping of the liquid toner by the gear pump 42, as a bearing for shaft 60, which passes through hole 66 in the plate cap (visible in FIG. 3), and as support for shaft 32, which does not rotate. Gear 34 rotates on the fixed shaft 32. The agitation paddle 30 is fixed to or is an integral part of gear 34. In one embodiment, the agitation paddle 30 is secured to the gear 34 by cap screws.

Figure 6:
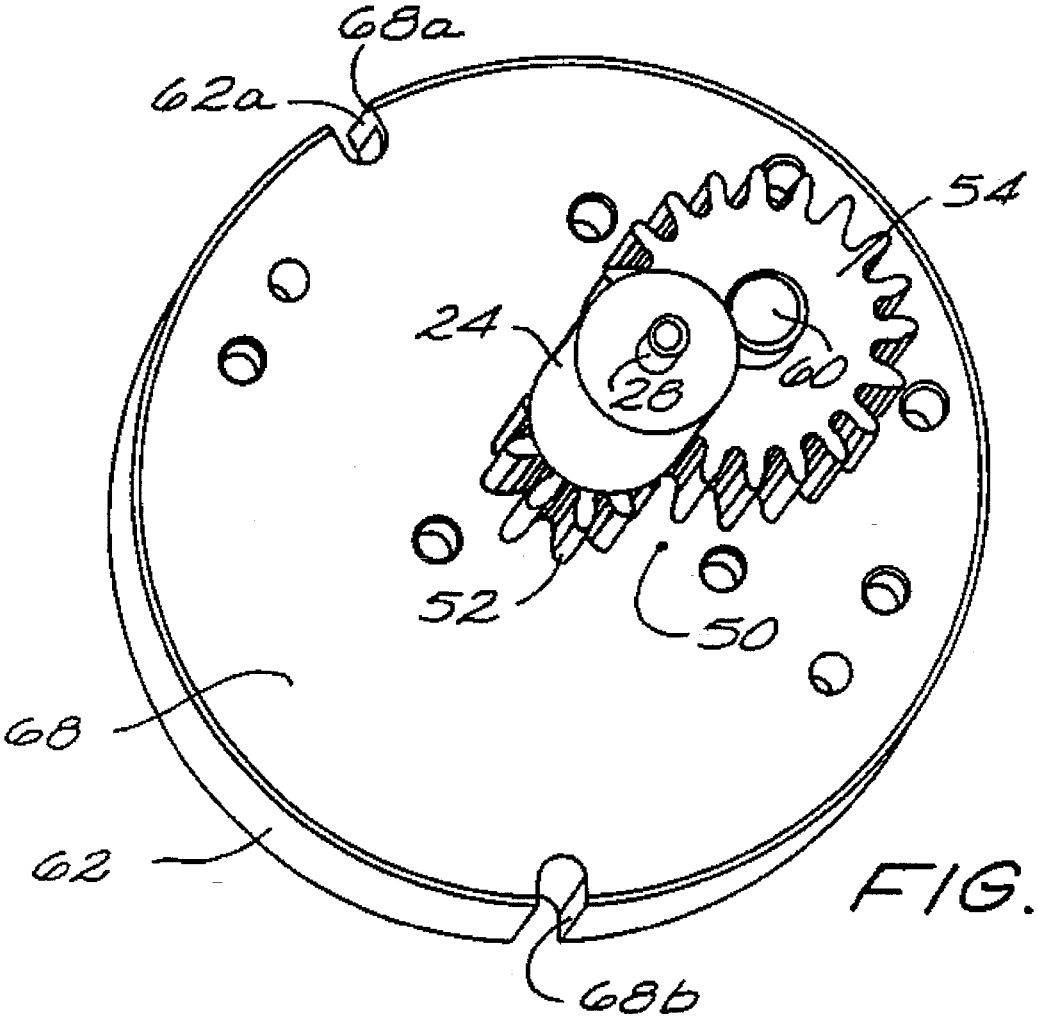
FIG. 6 is a perspective view of a plate cap and gasket assembly, employed as part of the gear pump and depicting an orifice for providing air intake.

A gasket 68 is provided for sealing the plate cap 62. The small orifice 50 is punched through the gasket 68 (see FIGS. 1 and 6); typically, the diameter of the orifice is about 0.010 inch. The orifice 50 (seen in FIGS. 1 and 6), which is sized to allow a small amount of air to be pumped out with the toner, is directly over toner intake port 72 of the pump gear 42 (see FIG. 7). A channel 73 (shown in FIG. 8) leads from notch 62*a* across the backside of the plate cap 62 and is part of the air intake/return supply line 48. The gasket 68 seals this air channel from the gear pump 42, as the air channel has to cross over the plate cap 62 to access the toner intake port 72. The orifice 50 provides a controlled amount of air to be pumped to the external development reservoir 18 along with the toner. As stated above, this allows toner and some air (if required) to be pumped back to the cartridge 10. Plate cap 62 and gasket 68 are also provided with openings 66 and 78, respectively, for accommodating the gear shaft 60 in slip fit.

As shown in FIG. 5, the shaft 32 passes through the gear 34 and terminates through a boss 80, which is part of gear 34. Shaft 32 passes all the way through boss 80; a retaining clip 82 (visible in FIG. 5) is used to secure gear 34 to shaft 32. The agitation paddle 30 is attached to the boss 80, such as by press fit or screws. The agitation paddle 30 comprises a plurality of blades 84, which, when rotating, keep the liquid toner in suspension in the liquid carrier or mix up any settled toner particles. The blades 84 are supported in position by agitation plates 86, 88. The agitation plate 86 is provided with an opening 90 which accommodates the boss 80 for securing the agitation paddle 30 thereon.

Preferably, the blades 84 comprise a compliant material or employ a mechanical device such as a spring 92 mounted on at least one blade (FIG. 3) and are adapted to just touch the inner wall of the tank casing 12*b* where settling of the solid toner particles is likely to occur. Alternatively, brushes or bristles of the requisite stiffness may be used in place of blades 84, or other suitable compliant means for keeping the solid particles from settling out.

The agitation paddle 30 preferably rotates at a speed of about 60 to 120 rpm. The rotation depends on the drive torque, the mixing speed required, and the particular type of agitation means 30 used.

The gear plate 58, the gasket 68, and the plate cap 62 are each provided with a notch, denoted "a" in the drawing. The notch 68*a* and small orifice 50 in gasket 68 provide air intake from the interior of the cartridge 10 to be pumped out to reservoir 18 with the liquid toner. This allows for flow of toner and air back to the cartridge 10 from the reservoir 18. Other openings visible in the drawings are for attaching plate cap 62 to gear plate 58 with screws, to locate gear plate 58 to plate cap 62, and for attaching the assembly formed by joining plate cap 62 to the gear plate 58 to rigid support member 12*a* with screws.

The present invention provides for venting through a single fluid supply/return line 38. When the line 38 empties between pumping cycles, the cartridge 10 can vent to atmosphere, since the reservoir 18 is vented to the atmosphere. During pumping, the flexible tank casing 12*b* partially collapses, but returns to its original shape when toner has returned at the end of each development cycle. At this point, the supply/return line 38 is again open to the atmosphere for venting. This action always maintains space for the rotary agitation system 30.

The design of the gear pump 26 is considered to be unique in that it uses different size gears 52, 54, 56, 34 to provide gear reduction to the agitation device 30 as well as provide pumping action of the liquid toner. It is noted that a conventional gear pump uses gears of the same size. In this connection, if agitation is not required, these gears 52, 54, 56, 34 may be of the same size.

The gear pump of the present invention operates at a speed within the range of 700 to 1500 rpm, depending on the flow rate of liquid toner desired, the drive torque, and the pressure required.

Figure 7:
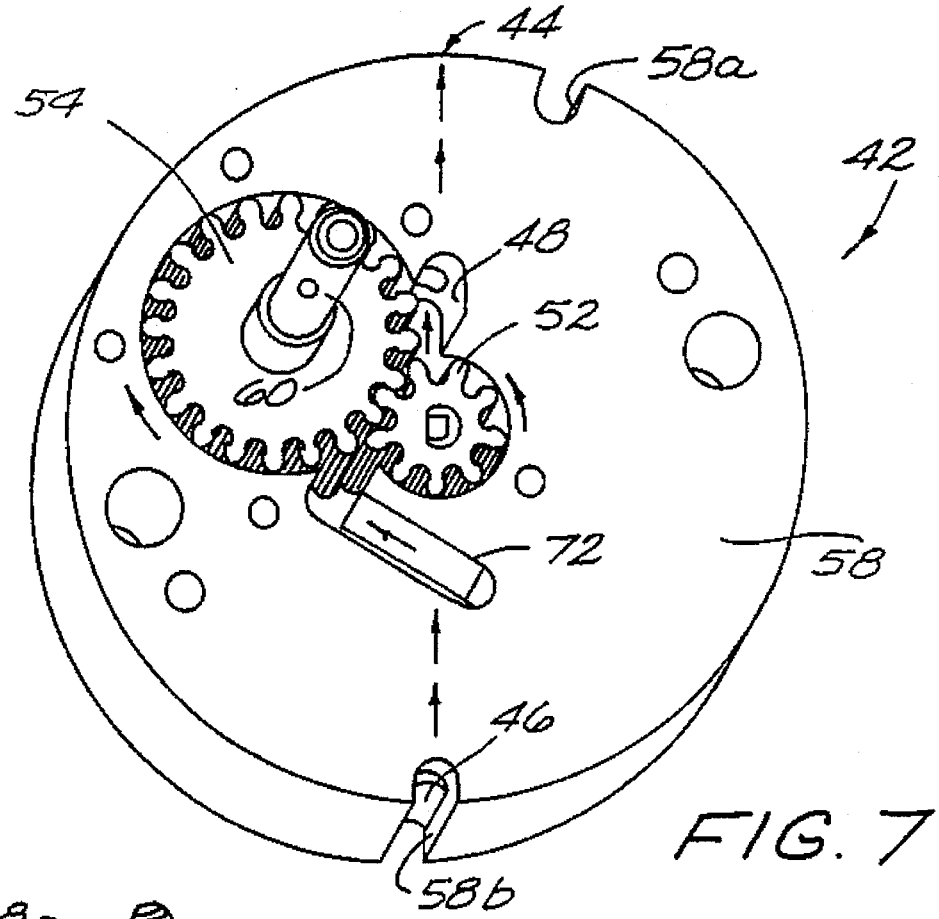
FIG. 7 is a perspective view of one side of the gear pump employed in the practice of the invention.
Figure 8:
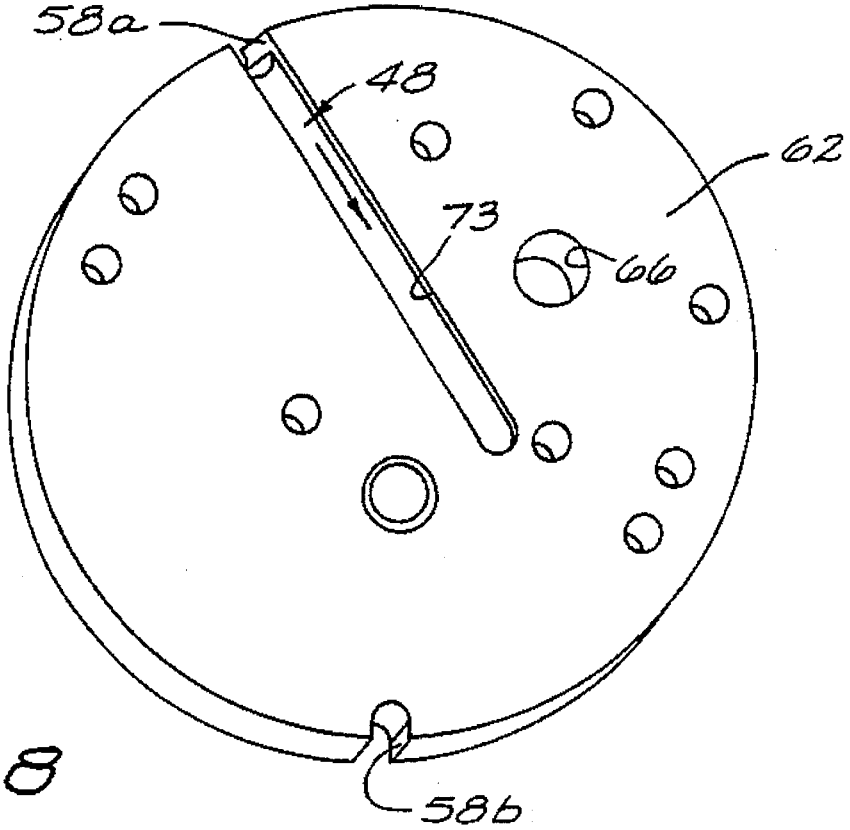
FIG. 8 is a perspective view of one side of the plate cap, showing an air flow path through the plate cap.

Turning now to FIG. 7, which shows details of the gear pump 42, intake 46, located at the bottom of the cartridge 10, provides a passage for toner to be moved to output channel 44 by the rotation of gears 52 and 54 (rotation of these gears is shown by the associated arrows).

Figure 9:
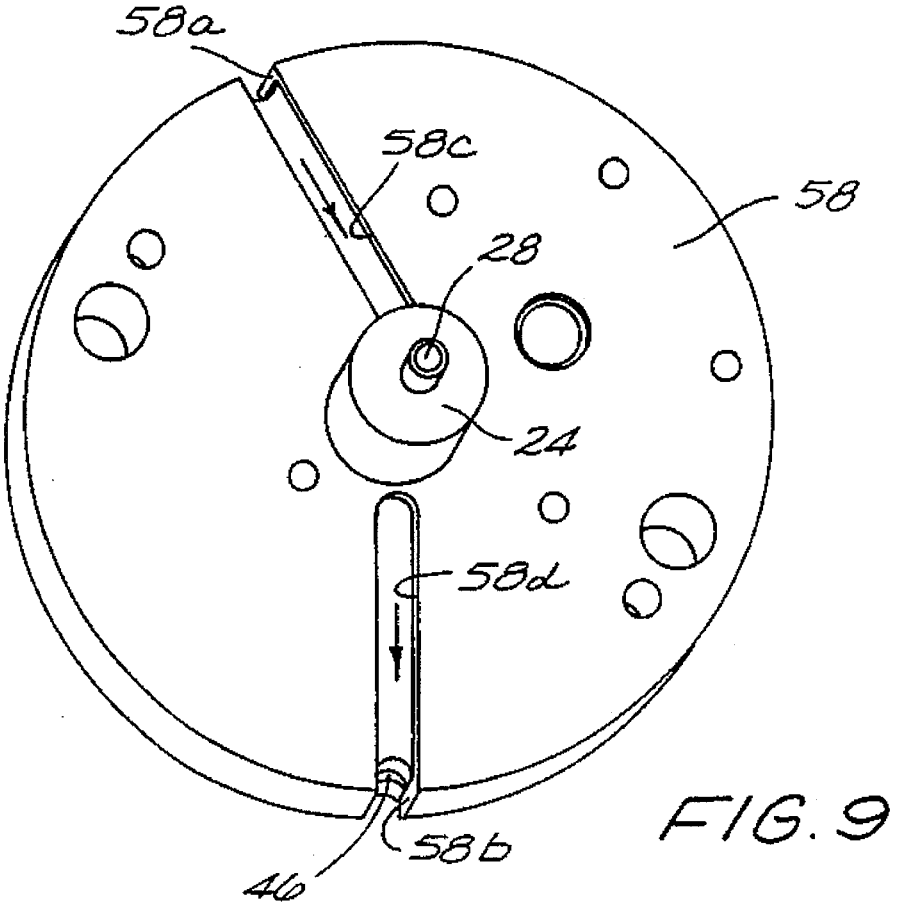
FIG. 9 is a perspective view of the other side of the gear plate (of FIG. 7), showing air flow and toner flow through the gear pump.

The internally ported gear pump 42 uses no tubes or connectors to or from the pump, and requires no seal since the pump is internal. A small amount of air pumps through internal porting (notch 68*a* and the small orifice 50 punched through gasket 68) with liquid toner during each cycle. Openings 58*a* and 68*a* provide air to flow through 58*c* into the boss 22 of rigid support member 12*a*, which contains rotor 24. This allows toner to flow out a channel 58*d* on the backside of gear plate 58 and into the intake channel 46 (see FIG. 9). It will be noted that the rotor 24 can run covered with liquid toner; no seals are required to keep the liquid toner out of this area.

From the foregoing description, it is seen that the present invention presents a unique configuration for a liquid toner cartridge 10 with internal rotary agitation. The cartridge 10 has no running seals or vent holes to the atmosphere that could leak during handling and has no internal switching valves. The liquid toner cartridge 10 of the invention uses a magnetically-coupled drive (seal not required) to provide power to the internal gear pump 49 and agitation system 30. The magnetically-coupled drive shaft 28 falls in line with the pump and agitation device 30. The venting arrangement allows toner and air to return during each cycle if required.

INDUSTRIAL APPLICABILITY

The liquid toner cartridge of the present invention is expected to find use in electrographic printing, particularly color printing employing liquid toners.

Thus, there has been described a liquid toner cartridge with internal agitation for maintaining the liquid toner in substantially uniform dispersion. It will be readily appreciated by those skilled in this art that various changes and modifications of an obvious nature may be made, and all such changes and modifications are considered to fall within the scope of the present invention, as defined by the appended claims.

What is claimed is:

1. A liquid toner cartridge for an electrographic image recording apparatus, comprising:

(a) a liquid-tight housing having an interior for containing liquid toner therein, said liquid toner comprising a dispersion of toner particles in an inert liquid carrier, said housing provided with a hollow boss at one end thereof, said housing further provided with a liquid inlet/outlet port adapted to be connected to an external liquid toner reservoir, said housing having an elongated axis;

(b) a magnetic rotor within said boss, said magnetic rotor adapted to be magnetically coupled to a magnetic motor driver outside of said boss;

(c) a pump for reversibly pumping said liquid toner from said external liquid toner reservoir into said housing and back; and (d) means for venting said interior of said housing to the atmosphere during a cycle.

2. The liquid toner cartridge of claim 1 further comprising a rotatable agitation means within said housing and along said elongated axis, said rotatable agitation means driven by a gear train mechanically coupled to said magnetic rotor, said rotatable agitation means for stirring said toner particles to maintain said dispersion.

3. The liquid toner cartridge of claim 2 wherein said pump comprises a gear pump which comprises a part of said gear train.

4. The liquid toner cartridge of claim 3 wherein said gear train comprises a plurality of gears to reduce rotation from said magnetic rotor to said rotatable agitation means.

5. The liquid toner cartridge of claim 4 wherein said gear train rotates said rotatable agitation means at a speed of about 60 to 120 rpm.

6. The liquid toner system of claim 3 wherein said gear pump operates at a speed of about 700 to 1500 rpm.

7. The liquid toner cartridge of claim 2 wherein said rotatable agitation means comprises a plurality of blades parallel to said elongated axis.

8. The liquid toner cartridge of claim 2 wherein said rotatable agitation means is adapted to stir up particles of said toner that may settle.

9. The liquid toner cartridge of claim 2 wherein said rotatable agitation means comprises a plurality of bristles which contact the interior of said housing.

10. A liquid toner cartridge provided with internal agitation means for an electrographic image recording apparatus, comprising:

(a) a liquid-tight housing for containing liquid toner therein, said liquid toner comprising a dispersion of toner particles in an inert liquid carrier, said housing provided with a hollow boss at one end thereof, said housing further provided with a liquid inlet/outlet port adapted to be connected to an external liquid toner reservoir, said housing having an elongated axis;

(b) a magnetic rotor within said boss, said magnetic rotor adapted to be magnetically coupled to a magnetic motor driver outside of said boss;

(c) a rotatable agitation means within said housing, said rotatable agitation means driven by a gear train mechanically coupled to said magnetic rotor, said rotatable agitation means for stirring said toner particles to maintain said dispersion;

(d) a gear pump comprising a part of said gear train for reversibly pumping said liquid toner from said external liquid toner reservoir to said rotatable agitation means and back; and (e) a means for venting to the atmosphere during a cycle.

11. The liquid toner cartridge of claim 10 wherein said rotatable agitation means comprises a plurality of blades parallel to said elongated axis.

12. The liquid toner cartridge of claim 10 wherein said rotatable agitation means is adapted to stir up particles of said toner that may settle.

13. The liquid toner cartridge of claim 10 wherein said rotatable agitation means comprises a plurality of bristles which contact the interior of said housing.

14. The liquid toner cartridge of claim 10 wherein said gear train comprises a plurality of gears to reduce rotation from said magnetic rotor to said rotatable agitation means.

15. The liquid toner cartridge of claim 14 wherein said gear train rotates said rotatable agitation means at a speed of about 60 to 120 rpm.

16. The liquid toner system of claim 10 wherein said gear pump operates at a speed of about 700 to 1500 rpm.

* * * * *